US007637391B2

(12) United States Patent
Rosenkranz et al.

(10) Patent No.: US 7,637,391 B2
(45) Date of Patent: Dec. 29, 2009

(54) COVER RELEASE MECHANISM FOR A DISPENSER

(75) Inventors: Mark E. Rosenkranz, Medina, OH (US); Aaron R. Reynolds, North Canton, OH (US); Robert L. Quinlan, Stow, OH (US)

(73) Assignee: Joseph S Kanfer, Richfield, OH (US)

( * ) Notice: Subject to any disclaimer, the term of this patent is extended or adjusted under 35 U.S.C. 154(b) by 512 days.

(21) Appl. No.: 11/515,078

(22) Filed: Sep. 1, 2006

(65) Prior Publication Data

US 2008/0054016 A1 Mar. 6, 2008

(51) Int. Cl.
*B67D 5/08* (2006.01)

(52) U.S. Cl. ..... 222/52; 222/181.3

(58) Field of Classification Search ..... 222/52, 222/63, 105, 180, 181.1, 181.2, 181.3, 183
See application file for complete search history.

(56) References Cited

U.S. PATENT DOCUMENTS 4,946,070 A * 8/1990 Albert et al. ..... 222/52
5,248,066 A * 9/1993 Olson et al. ..... 222/105
5,465,877 A 11/1995 Bell et al.
6,131,773 A 10/2000 Wade et al.
6,325,245 B1 * 12/2001 Matthews ..... 222/52
6,390,329 B1 * 5/2002 Maddox ..... 222/25
6,772,916 B1 8/2004 Reynolds
6,877,642 B1 4/2005 Maddox et al.
2005/0284888 A1 12/2005 Rhodenbaugh et al.

* cited by examiner

*Primary Examiner*—Kevin P Shaver
*Assistant Examiner*—Daniel R Shearer
(74) *Attorney, Agent, or Firm*—Renner, Kenner, Greive, Bobak, Taylor & Weber

(57) ABSTRACT

A dispenser includes a cover pivotally secured to a backplate to move between an open position, at which the dispenser can be refilled, and a closed position, at which the dispenser may be actuated. The cover includes a latch that engages a catch held on the backplate. An elongate bar secured to the backplate is provided to engage the latch and remove it from the catch to permit the cover to be moved to the open position. The elongate bar includes a yoke extending to left and right terminal ends that are accessible outside of a dispensing zone of the dispenser. This invention is particularly applicable to dispensers that employ sensors to sense the presence of a hand at a dispensing zone.

7 Claims, 4 Drawing Sheets

COVER RELEASE MECHANISM FOR A DISPENSER

TECHNICAL FIELD

This invention generally relates to dispensers, and, particularly, relates to cover release mechanisms for dispensers. This invention is found to be particularly useful in "hands-free" type wall-mounted dispensers that employ sensors to activate dispensing means rather than dispensing upon a user physically manipulating a portion of the dispenser.

BACKGROUND OF THE INVENTION

This invention relates particularly to wall-mounted dispensers of which there are a variety known to the art. In general, wall-mounted dispensers include a backplate and cover that is capable of being opened to permit the dispenser to receive replaceable cartridges or refill packages containing the desired material to be dispensed. These dispensers are more or less permanent installations in areas such as lavatories, restrooms, food handling areas, hospitals, etc. In some embodiments, the cover is pivotally secured to the backplate on a hinge such that the cover can pivot from a closed position, whereat the dispenser may be actuated to dispense material, and an open position, whereat the dispenser can be serviced or refilled. In embodiments such as that shown in U.S. Pat. No. 6,877,642, the cover is held in the closed position through a latching mechanism. A latch carried by the cover engages a catch carried by the backplate, and an elongate bar carried by the backplate can be moved to engage the latch and remove it from the catch, thus permitting the dispenser to be opened. The elongate bar is accessible at the center-bottom of the dispenser.

These latching mechanisms have proved to be problematic when incorporated into "hands-free" type dispensers. Hands-free type dispensers dispense product when a hand is detected at a dispensing zone by one or more sensors. They are very popular because an individual using the dispenser does not have to manipulate any physical portion of the dispenser. Rather, the individual can simply place their hand at the dispensing zone, and the dispenser will dispense product upon detection of the hand by the sensors. In the prior art, the elongate bar that is used to disengage the latch from the catch is located at the dispensing zone. Thus, this configuration cannot be incorporated into hands-free type dispensers inasmuch as, when one attempts to open the dispenser by manipulating the elongate bar at the dispensing zone, the dispenser will dispense product.

Thus, there is a need in the art for a release mechanism for a cover portion of a wall-mounted dispenser that does not have the user-manipulated elements placed in the dispensing zone. Inasmuch as the dispensing zone in many wall-mounted dispensers is generally centrally located, there exists a need in the art where the mechanisms for opening the dispenser are accessible to the left or right of a generally centrally located dispensing zone.

SUMMARY OF THE INVENTION

It is an object of this invention to provide a wall-mounted dispenser having features not provided in the prior art for opening the dispenser. Although this invention is particularly useful in wall-mounted hands-free type dispensers, the practice of this invention is not limited thereto.

In general, this invention provides a wall-mounted dispenser that includes a backplate mounted to affix the dispenser to a wall structure. The backplate has a catch proximate a top of the backplate. A cover is pivotally secured to the backplate proximate a bottom of the backplate to move between an open position, at which the dispenser may be refilled, and a closed position, at which the dispenser may be actuated. The cover includes a latch that engages the catch associated with the backplate, this engagement serving to retain the cover in the closed position. An elongate bar is secured to the backplate and has a yoke end opposite a latch release end. The elongate bar is biased so that the latch release end rests proximate the latch on the cover, and is biased in a direction away from the latch. A yoke extends from the yoke end of the elongate bar to a left terminal end accessible at a left hole in the cover and a right terminal end accessible at a right hole in the cover. Pressing on either the left or right terminal end moves the elongate bar against its bias and causes the latch release end to contact and remove the latch from the catch, permitting the cover to be moved to its open position.

In particular embodiments, the wall-mounted dispenser further includes a dispensing outlet and a hands-free dispensing sensor that, upon sensing the presence of an object near the dispensing outlet, effects a dispensing of product without the need for human manipulation of the dispenser. The placement of the hands-free dispensing sensor is such that it does not sense the presence of an object pressing upon the left or right terminal end of the yoke.

In another embodiment, this invention provides a dispenser that includes a dispensing zone and at least one sensor having a sensing area encompassing the dispensing zone, the dispenser dispenses product at the dispensing zone when the at least one sensor senses the presence of an object at the sensing area. The dispenser further includes a backplate having a catch, and a cover pivotally secured to the backplate to move between an open position, at which the dispenser may be refilled, and a closed position, at which the dispenser may be actuated, the cover including a latch that engages the catch in the closed position, with the engagement thereof serving to hold said cover in said closed position. An elongate bar secured to the backplate and has a latch release end. The elongate bar is biased so that the latch release end rests proximate the latch on the cover, and the latch release end is biased in a direction away from the latch. A yoke extends from the elongate bar to a left terminal end accessible at a left hole in the cover and a right terminal end accessible at a right hole in the cover. The left and right terminal ends of the yoke are positioned outside of the sensing area and pressing on the left or right terminal end moves the elongate bar against its bias and causes the latch release end to contact and remove the latch from the catch, permitting the cover to be moved to its open position.

PREFERRED EMBODIMENT FOR CARRYING OUT THE INVENTION

Figure 1:
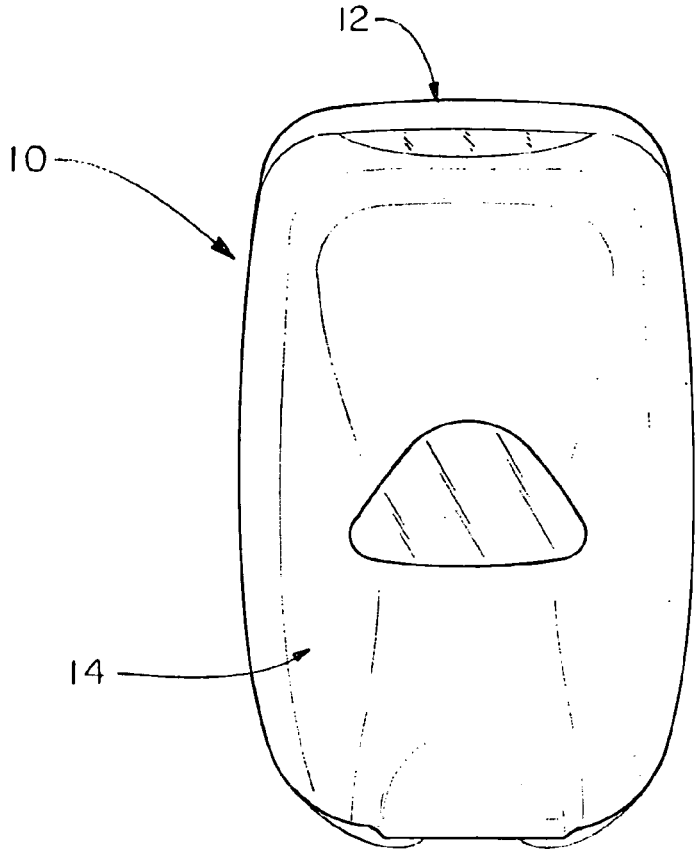
FIG. 1 is a front elevational view of a dispenser of this invention as it may be used to hold and dispense a fluid product.
Figure 2:
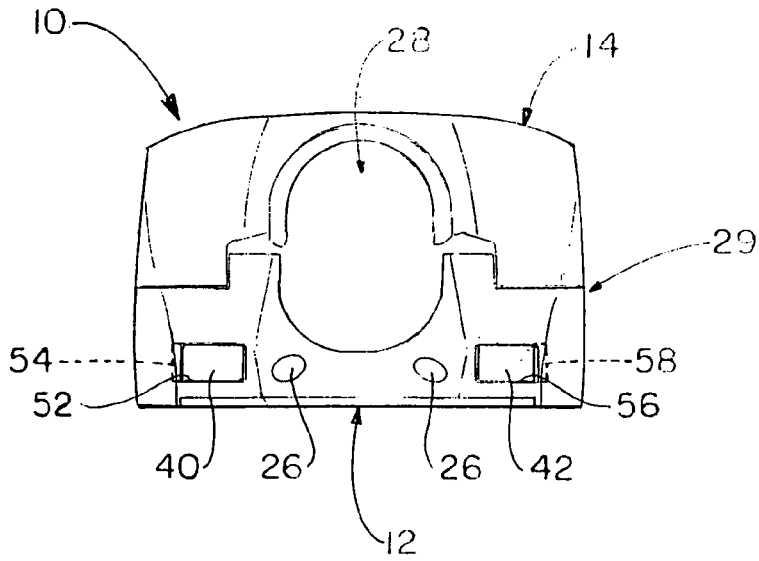
FIG. 2 is a bottom view of the dispenser shown in FIG. 1.
Figure 4:
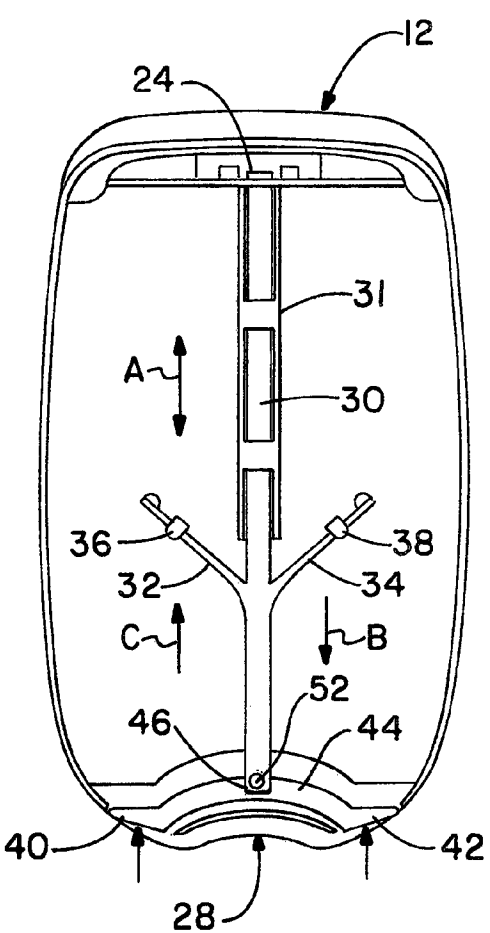
FIG. 4 is a front elevational view of the backplate showing a portion of a cover locking mechanism mounted within the interior thereof.
Figure 3:
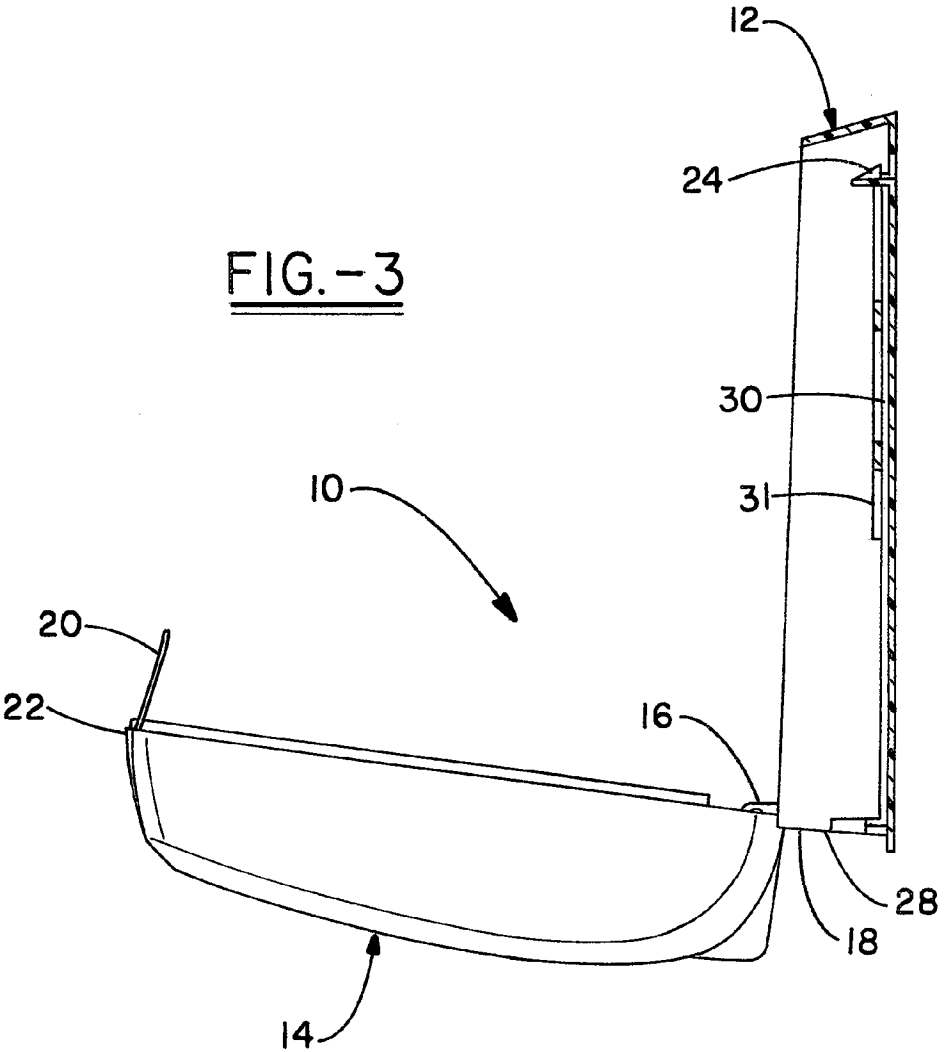
FIG. 3 is a right side elevational view showing the cover in the open position and the backplate in cross-section.
Figure 6:
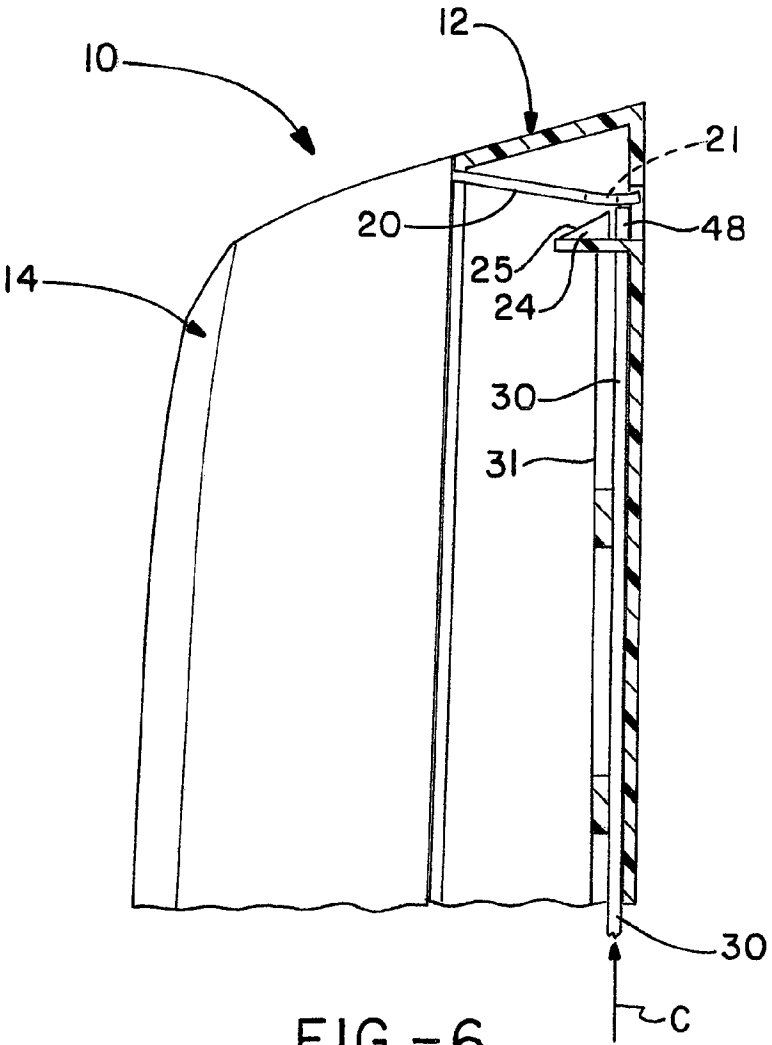
FIG. 6 is a partial side elevational view similar to FIG. 5 but showing the locking mechanism in the disengaged position for opening the cover.
Figure 5:
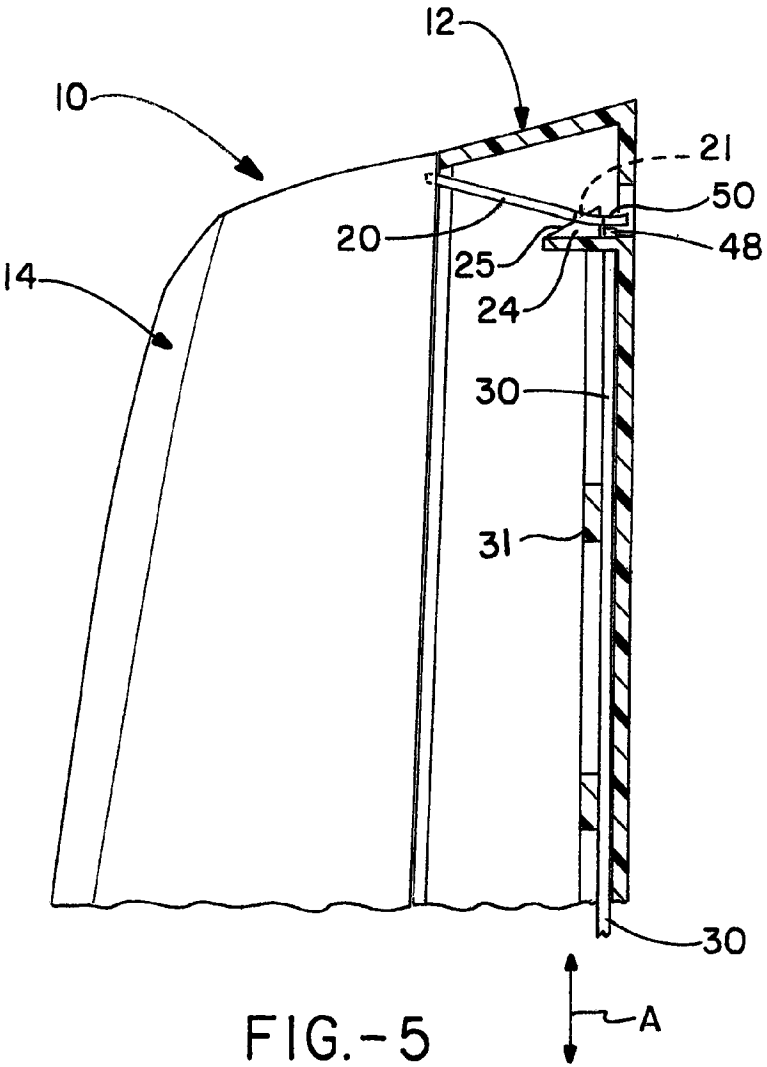
FIG. 5 is a partial side elevational view with the top end of the backplate in cross-section showing the cover locking mechanism in the closed position.

Referring first to FIGS. 1-4, a wall-mounted dispenser in accordance with this invention is shown and designated by the numeral 10. Dispenser 10 includes backplate 12, which is adapted for mounting to a wall structure as generally known in the wall-mounted dispenser arts. Cover 14 is pivotally secured to backplate 12, as at hinge 16, proximate bottom edge 18 of backplate 12. Cover 14 can pivot between a closed position, as shown in FIGS. 1 and 5, and an open position, as shown in FIG. 3. In the closed position, latch 20, which is associated with cover 14 and located near top edge 22 thereof, engages catch 24, which is associated with backplate 12, to keep dispenser 10 closed and ready for use. With reference to FIGS. 5 and 6, it can be seen that latch 20 includes an aperture 21 that receives catch 24 when cover 14 is closed on backplate 12. It should further be appreciated that latch 20 rides up on the sloped surface 25 of catch 24 as cover 14 is being closed upon backplate 12. This urges latch 20 out of its normal resting position, until catch 24 aligns with aperture 21 and latch 20 snaps into place. In order to move cover 14 to the open position, for example, for servicing or refilling, latch 20 and catch 24 must be disengaged. In the prior art, an elongate bar accessible at the center of the bottom edge of a dispenser backplate would be provided for that purpose. But with current hands-free dispensing technologies, wherein sensors are provided to detect the presence of a hand at the center bottom edge of the dispenser, using such prior art elongate bars is not practical because accessing the centrally located elongate bar will cause the sensor to be tripped, and the dispenser will dispense product onto either the individual attempting to open it or onto the floor, making a mess and wasting product in either case. In light of the fact that the prior art has not addressed this complication encountered in the hands-free dispenser arts, this invention is perhaps best suited and will be most beneficially applicable to this environment. However, this invention is not limited to such an application inasmuch as the structures disclosed herein might be found to be beneficial in other environments.

Figure 7:
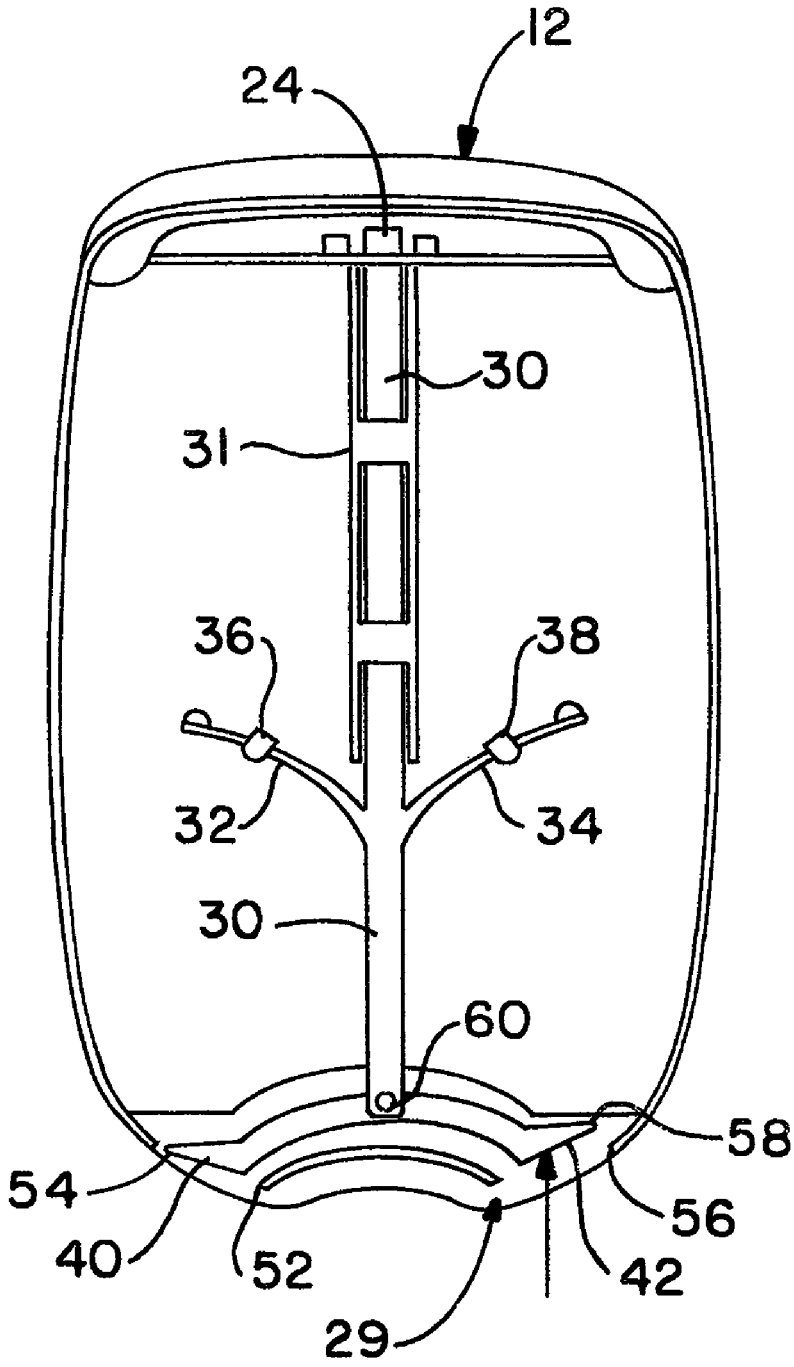
FIG. 7 is a front elevational view as in FIG. 4, shown with the portion of the cover locking mechanism mounted to the backplate being pushed upwardly at a terminal end thereof.

Thus, in accordance with preferred embodiments, dispenser 10 carries one or more hands-free dispenser sensors 26 proximate a dispensing zone 28 (FIG. 2) in base extension 29, which can be formed from extensions off of cover 14 or backplate 12 or both, shown here as both. Sensors 26 sense the presence of a hand at dispensing zone 28 and cause product to be dispensed at dispensing zone 28 without the need for human manipulation of the dispenser. Referring now to FIGS. 3-6, elongate bar 30 is carried on backplate 12 for example, by guide sleeve 31, and is capable to moving vertically as shown by arrow A. More particularly, elongate bar 30 is biased to move downwardly in the direction of arrow B by resilient arms 32, 34 that extend at an angle from elongate bar 30 into arm guides 36, 38 in backplate 12. Elongate bar 30 can be moved upward in the direction of arrow C, against the bias of resilient arms 32, 34, by pushing upwardly on left terminal end 40 or right terminal end 42 of yoke 44, which is pivotally secured to yoke end 46 of elongate bar 30. With particular reference to FIGS. 5 and 6, it can be seen that moving elongate bar 30 in the direction of arrow C causes latch release end 48 of elongate bar 30 to contact a portion of latch 20, and further movement in the direction of arrow C thus forces latch 20 off of catch 24 to permit the opening of cover 14. Although other structures could be used, in this embodiment, latch release end 48 engages latch extension 50 of latch 20 and forces aperture 21 off of catch 24. As seen in FIG. 7 if elongate bar 30 is moved upwardly, resilient arms 32, 34 are stressed against arm guides 36, 38 to an abnormal shape, and it will be appreciated that, once permitted to, they will revert back to their normal shape as shown in FIG. 4. It should also be appreciated, as shown in FIG. 7, that when one of left terminal end 40 or right terminal end 42 is moved upwardly the other of the left terminal end 40 or right terminal end 42 serves as the support or fulcrum for the upward movement of yoke 44. More particularly, left terminal end 40 is aligned with left release aperture 52, and extends beyond aperture 52 to provide a pivot flange 54 resting on a portion of base extension 29, and, similarly, right terminal end 42 is aligned with right release aperture 56 and extends beyond aperture 56 to provide pivot flange 58 resting on a portion of base extension 29. In FIG. 7, right terminal end 42 is pushed upwardly, with yoke 44 pivoting upwardly on pivot flange 54. Thus, it is helpful to have yoke 44 pivotally secured to elongate bar 30, as already mentioned, and shown at pivot pin 60.

As perhaps best seen in FIG. 2, left and right terminal ends 40, 42 are accessible at left and right sides, respectively, of dispensing zone 28. Therefore, elongate bar 30 can be manipulated, and dispenser 10 can thus be opened, by pressing on left or right terminal ends 40, 42. This can be done without tripping sensors 26, which are positioned to detect the presence of a hand at dispensing zone 28.

In light of the foregoing, it should thus be evident that the process of the present invention, provides advances in the art of wall-mounted dispensers, particularly hands-free type wall-mounted dispensers that employ sensors to detect the presence of a hand at a dispensing zone. While, in accordance with the patent statutes, only the preferred embodiments of the present invention have been described in detail hereinabove, the present invention is not to be limited thereto or thereby. Rather, the scope of the invention shall include all modifications and variations that fall within the scope of the attached claims.

What is claimed is:

1. A wall-mounted dispenser comprising:

a backplate mounted to affix the dispenser to a wall structure, said backplate having a catch proximate a top of said backplate and a base extension proximate a bottom of said backplate;

a cover pivotally secured to said backplate proximate a bottom of said backplate to move between an open position, at which the dispenser may be refilled, and a closed position, at which the dispenser may be actuated, said cover including a latch that engages said catch in said closed position, with the engagement thereof serving to hold said cover in said closed position;

an elongate bar secured to said backplate and having a yoke end opposite a latch release end, said elongate bar being biased so that said latch release end rests proximate said latch on said cover, said latch release end being biased in a direction away from said latch; and a yoke extending from said yoke end of said elongate bar to a left terminal end accessible at a left hole in said base extension and a separate and distinct right terminal end accessible at a separate and distinct right hole in said base extension, wherein pressing on said left or right terminal end moves said elongate bar against its bias and causes said latch release end to contact and remove said latch from said catch, permitting said cover to be moved to its open position.

2. The wall-mounted dispenser of claim 1, further comprising:

a dispensing outlet; and a hands-free dispensing sensor that, upon sensing the presence of an object near said dispensing outlet, effects a dispensing of product without the need for human manipulation of the dispenser, wherein the placement of said hands-free dispensing sensor is such that it does not sense the presence of an object pressing upon said left or right terminal end of said yoke.

3. The wall-mounted dispenser of claim 1, wherein said elongate bar is biased by resilient arms extending from said elongate bar into arm guides in said backplate, said resilient arms being deformed within said arm guides when said first or second terminal ends of said yoke is pressed, then reverting back toward their normal shape when that pressure is removed from said first or second terminal ends.

4. The dispenser of claim 1, wherein, when said left terminal end is pressed to cause said latch release end to contact and remove said latch from said catch, the right terminal end serves as the fulcrum for the upward movement of said yoke, and when said right terminal end is pressed to cause said latch release end to contact and remove said latch from said catch, the left terminal end serves as the fulcrum for the upward movement of said yoke.

5. A dispenser comprising:

a dispensing zone;

at least one sensor having a sensing area encompassing said dispensing zone, the dispenser dispensing product at the dispensing zone when said at least one sensor senses the presence of an object at said sensing area;

a backplate having a catch;

a base extension;

a cover pivotally secured to said backplate to move between an open position, at which the dispenser may be refilled, and a closed position, at which the dispenser may be actuated, said cover including a latch that engages said catch in said closed position, with the engagement thereof serving to hold said cover in said closed position;

an elongate bar secured to said backplate and having a latch release end, said elongate bar being biased so that said latch release end rests proximate said latch on said cover, said latch release end being biased in a direction away from said latch; and a yoke extending from said elongate bar to a left terminal end accessible at a left hole in said base extension and a separate and distinct right terminal end accessible at a separate and distinct right hole in said base extension, wherein pressing on said left or right terminal end moves said elongate bar against its bias and causes said latch release end to contact and remove said latch from said catch, permitting said cover to be moved to its open position, said left and right terminal ends of said yoke being positioned outside of said sensing area.

6. The dispenser of claim 5, wherein, when said left terminal end is pressed to cause said latch release end to contact and remove said latch from said catch, the right terminal end serves as the fulcrum for the upward movement of said yoke, and when said right terminal end is pressed to cause said latch release end to contact and remove said latch from said catch, the left terminal end serves as the fulcrum for the upward movement of said yoke.

7. The dispenser of claim 5, wherein the dispensing zone is located below said base extension.

* * * * *

UNITED STATES PATENT AND TRADEMARK OFFICE

CERTIFICATE OF CORRECTION

PATENT NO. : 7,637,391 B2
APPLICATION NO. : 11/515078
DATED : December 29, 2009
INVENTOR(S) : Rosenkranz It is certified that error appears in the above-identified patent and that said Letters Patent is hereby corrected as shown below:

Column 5, line 14-20, delete claim 3, and replace with the following:

3. The wall-mounted dispenser of claim 1, wherein said elongate bar is biased by resilient arms extending from said elongate bar into arm guides in said backplate, said resilient arms being deformed within said arm guides when said left or right terminal ends of said yoke is pressed, then reverting back toward their normal shape when that pressure is removed from said left or right terminal ends.

Signed and Sealed this

Twenty-first Day of September, 2010

David J. Kappos

David J. Kappos
*Director of the United States Patent and Trademark Office*